US006640450B2

(12) United States Patent
Teague

(10) Patent No.: US 6,640,450 B2
(45) Date of Patent: Nov. 4, 2003

(54) COMBINED WRITING AND WINDOW BREAKING DEVICE

(76) Inventor: David A. Teague, 925 Arrowhead Dr., Elwood, IL (US) 60421

( * ) Notice: Subject to any disclaimer, the term of this patent is extended or adjusted under 35 U.S.C. 154(b) by 41 days.

(21) Appl. No.: 10/074,728

(22) Filed: Feb. 13, 2002

(65) Prior Publication Data

US 2003/0150119 A1 Aug. 14, 2003

(51) Int. Cl.[7] ..... B26F 1/32
(52) U.S. Cl. ..... 30/367; 30/123; 30/366
(58) Field of Search ..... 30/358, 359, 366, 30/367, 123

(56) References Cited

U.S. PATENT DOCUMENTS 3,249,091 A * 5/1966 Griesbach ..... 30/280
5,421,460 A * 6/1995 Bosshard ..... 30/123
5,557,818 A * 9/1996 Leon ..... 30/162
5,657,543 A * 8/1997 Collins ..... 30/367
5,791,056 A * 8/1998 Messina ..... 30/367
5,916,278 A * 6/1999 Garcia ..... 7/165
6,223,441 B1 * 5/2001 Parsons ..... 30/367
6,453,564 B1 * 9/2002 Foley ..... 30/359

FOREIGN PATENT DOCUMENTS

FR 2 598 346 * 11/1987

* cited by examiner

*Primary Examiner*—Hwei-Siu Payer
(74) *Attorney, Agent, or Firm*—Cherskov & Flaynik

(57) ABSTRACT

A combined writing and window breaking device (10) includes a pen portion (12), a biasing spring (14), a slide portion (16) that comprises part of the pen portion (12), and a breaking member (18). The breaking member (18) is cooperatively coupled to the pen portion (12) such that a user is able to slide the breaking member (18) from a non-biased to a biased position. When the device (10) is disposed proximate to a window to be broken, the user releases the breaking member (18) whereupon, the biasing spring (14) forcibly moves the striking member (18) into the window to break same. After completing the breaking operation, the user places the device (10) into his or her pocket to function as a typical writing instrument when required.

20 Claims, 6 Drawing Sheets

COMBINED WRITING AND WINDOW BREAKING DEVICE

BACKGROUND OF THE INVENTION

1. Field of the Invention

The present invention relates to devices serving multiple function and more particularly, to a device that combines a writing instrument and a window breaking tool.

2. Background of the Prior Art

Multiple function devices are common and include combined writing and cutting instruments (U.S. Pat. No. 3,249,091), writing and turning tools (U.S. Pat. No. 5,916,278), emergency window breaking tools (U.S. Pat. Nos. 5,097,599; 5,542,139; 5,657,543; 5,791,056; 6,079,071 and 6,223,441), and combination flashlight tools (U.S. Pat. Nos. 6,139,165; and 6,199,997). Generally, these prior art devices are relatively large, bulky, expensive and unable to fit in a user's shirt pocket thereby making the devices easy to forget and/or not included during an emergency situation. Further, none of the devices disclose a device combining a writing instrument and a window breaking tool.

A need exists for a writing and window breaking device that is small, light weight, inexpensive, easily replaced and fits into a user's pocket. The writing instrument needs to be comfortable to use and functions as an ordinary pen would thereby increasing the likelihood that a user would keep the device in his or her pocket and have the device available during an emergency situation that requires the user to break a window of a premises to gain access to assist someone therein. The window breaking portion of the device needs to be forcefully sufficient to facilitate the breaking of a window when the user positions the device proximate to the window. Further, the window breaking portion needs to function via one hand of the user during any type of weather to gain quicker access to the premises.

SUMMARY OF THE INVENTION

It is an object of the present invention to overcome many of the disadvantages associated with devices that combine a writing instrument with a mechanical tool.

A principle object of the present invention is to provide a device that combines a writing instrument with a window breaking tool. A feature of the device is a biased breaking member. An advantage of the device is that the user does not have to thrust his or her hands toward the window, as is current practice when using a knife or flashlight, in order to break the window thereby avoiding injury to their hands.

Another object of the invention is to provide a relatively small device for breaking a window. A feature of the device is a small biasing spring that provides substantial driving force. Another feature is a pointed, metal striking tip that forcibly engages the window to break same. An advantage of the device is that it is easily carried in the user's pocket and quickly available in emergency situations.

Yet another object of the present invention is to provide a writing instrument. A feature of the device is a standard pen portion that is comfortable to handle. An advantage of the device is that it is a good writing tool that provides a common daily use thereby increasing the likelihood that the user will carry the device constantly in a pocket, and decreasing the likelihood that the device will be forgotten when the user is called to an emergency situation where the window breaking capability of the device is required.

Still another object of the present invention is to provide a device that is easily held in one hand. A feature of the device is a cushion secured to a gripping portion. Another feature of the device is a finger grip joined to the breaking member. An advantage of the device is that it may be quickly operated with just one hand of the user. Another advantage of the device is that it will not slip from the user's grasp during inclement weather.

Another object of the present invention is to provide a device that is relatively stable during operation. A feature of the device is a spring receiving portion that includes an insertion portion that inserts into a second end of the spring a predetermined distance. An advantage of the device is that the breaking member is stable when moved by the spring upon a slide portion into forcible engagement with the window.

Another object of the present invention is to provide a device that allows for a distance of separation between an actuator end of the device and the window. A feature of the device is the extension of the striking tip beyond the actuator. An advantage of the device is that the user does not have to engage the window with the device while compressing the biasing spring thereby providing a relatively safe distance of separation.

Another object of the present invention is to provide a device that has no "lose" parts when in a non-biased position. A feature of the device is a relatively slight bias provided by the bias spring when fully extended upon the slide portion. An advantage of the device is that the striking member is maintained at an end portion of the slide member to prevent the device from moving in the user's pocket when the clip portion engages an edge portion of the user's pocket.

Briefly, the invention provides a combined writing and window breaking device comprising a pen portion; a breaking member cooperatively coupled to said pen assembly; means for moving said breaking member from a first position to a second position relative to said pen portion; and means for biasing said breaking member at said second position to forcibly displace said breaking member from said second position to said first position whereby said breaking member is capable of breaking a window when a predetermined portion of said pen portion is disposed proximate to the window.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DETAILED DESCRIPTION OF THE PREFERRED EMBODIMENT

Figure 1:
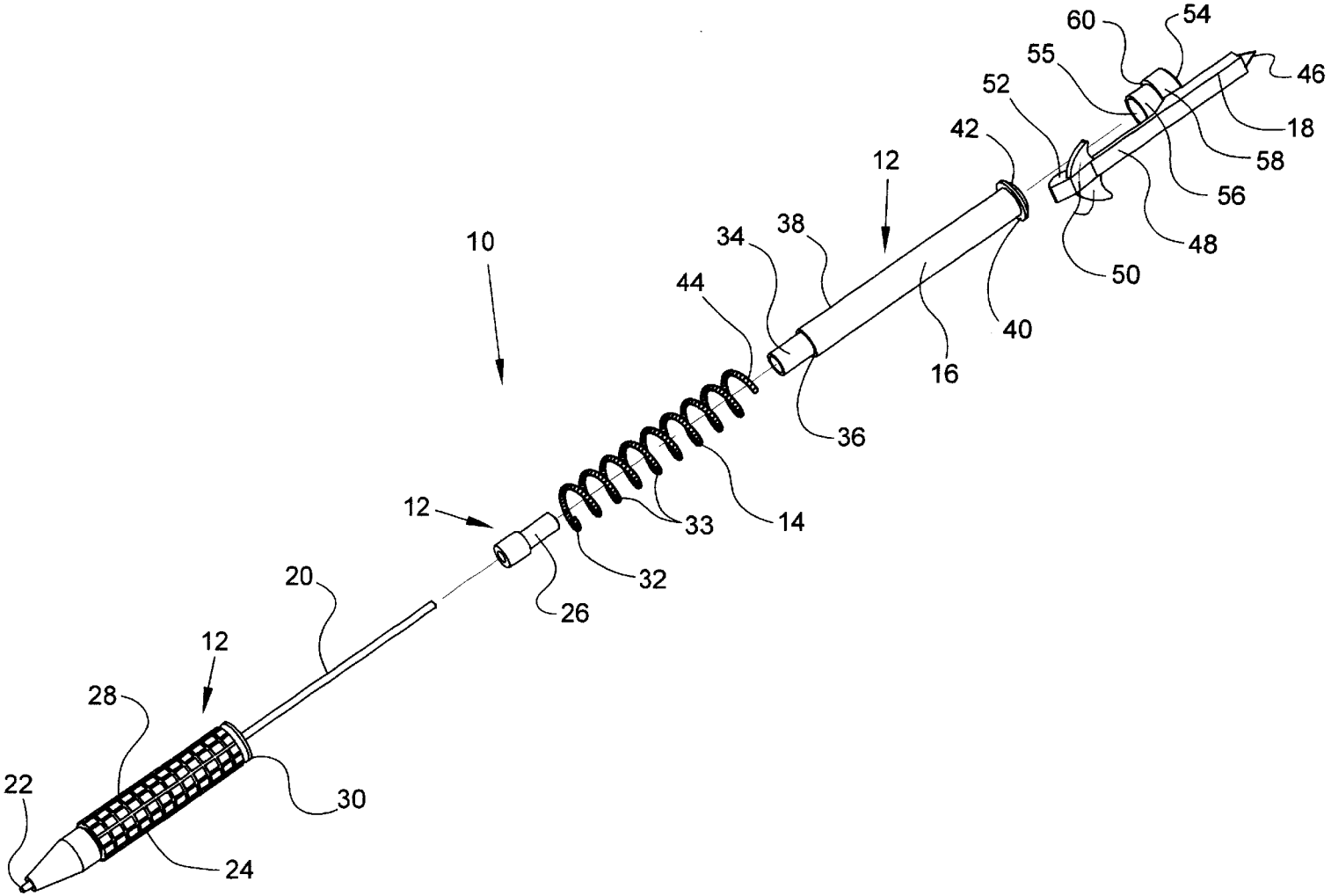
FIG. 1 is an exploded, perspective view of a combined writing and window breaking device in accordance with the present invention.
Figure 2:
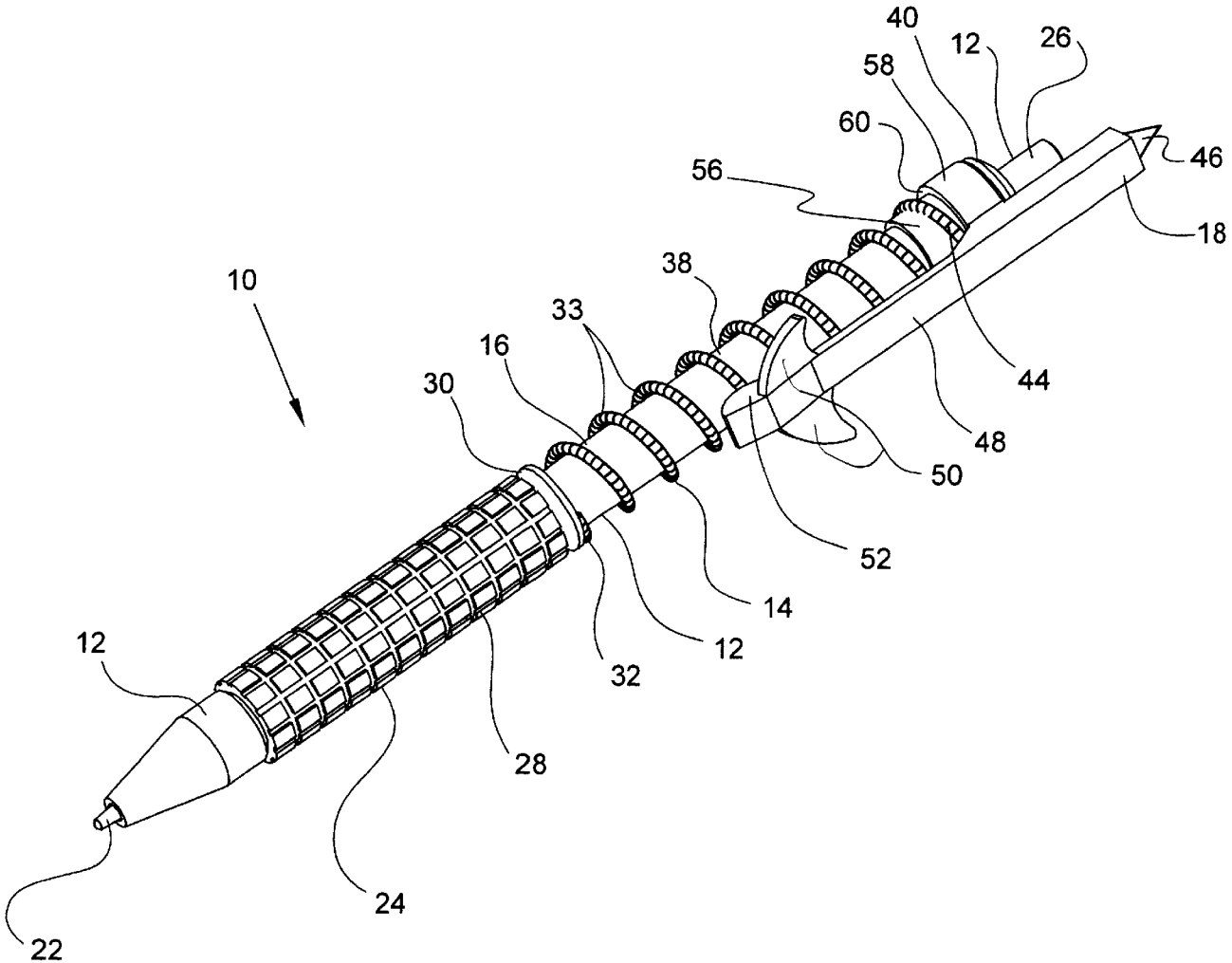
FIG. 2 is a perspective view of a combined writing and window breaking device in a non-biased position in accordance with the present invention.
Figure 3:
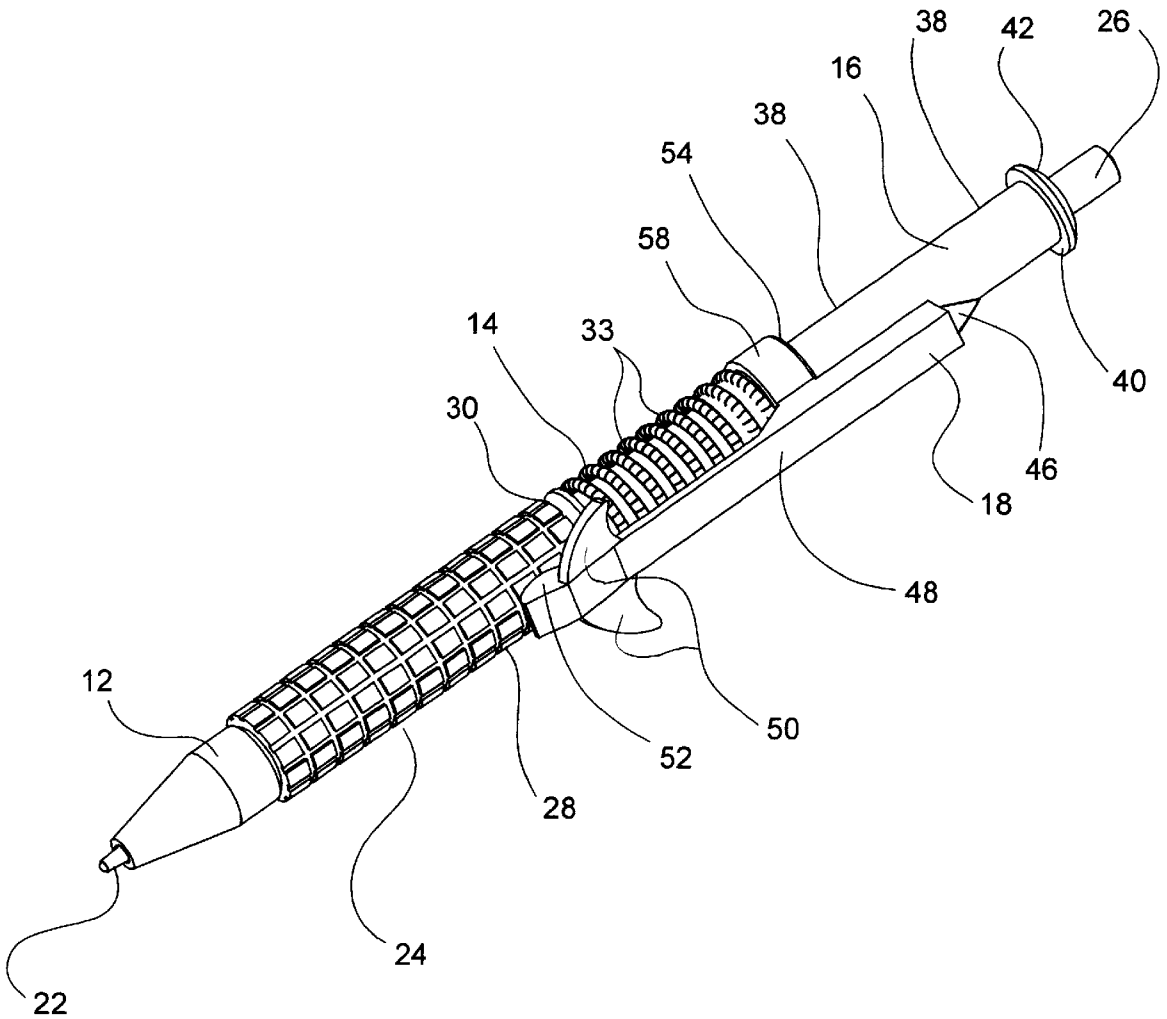
FIG. 3 is a perspective view of the combined writing and window breaking device of FIG. 2 but in a biased position.
Figure 4:
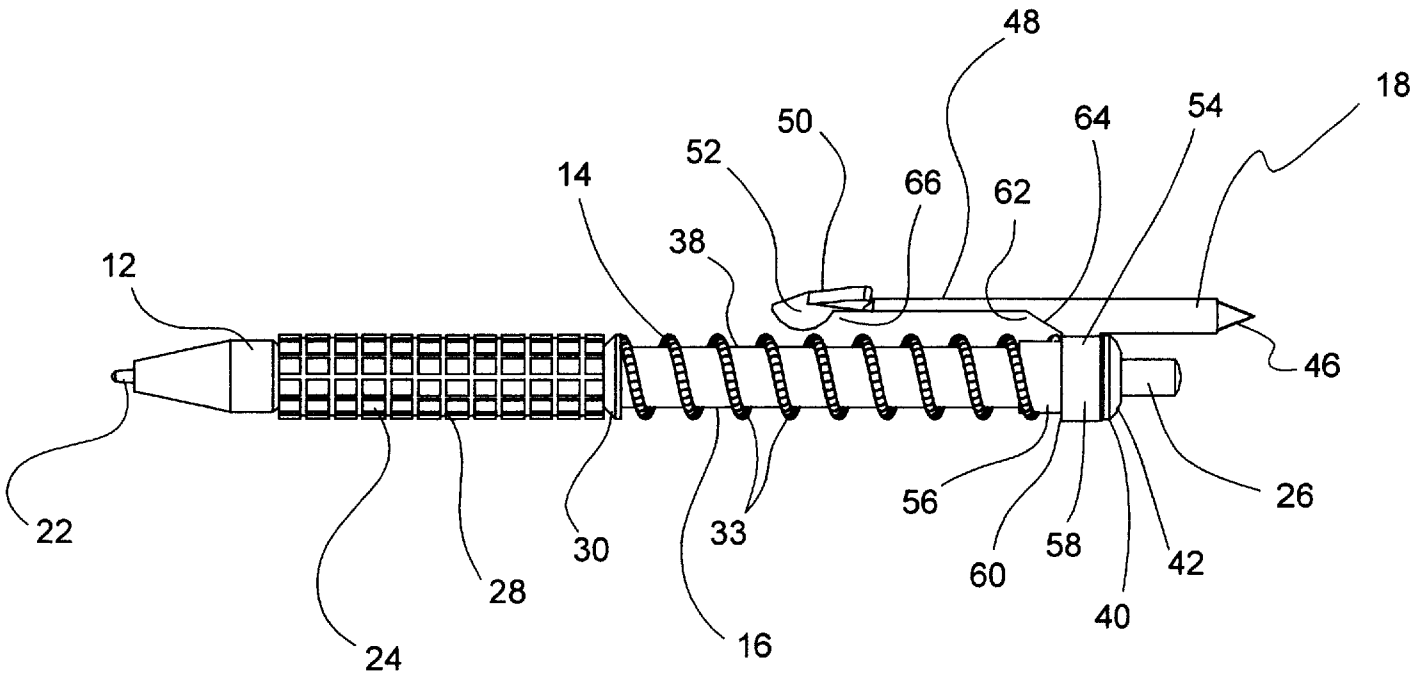
FIG. 4 is a side elevation view of the device of FIG. 2.

Referring now to the figures and in particular to FIGS. 1–4, a combined writing and window breaking device is denoted by numeral 10. The device 10 includes a pen portion 12, a biasing spring 14, a slide member 16 that comprises part of the pen portion 12, and a breaking member 18. The pen portion 12 is generally cylindrically configured and comprised of typical pen components including a ink supply tube 20 with a writing tip 22, a gripping portion 24 and actuator 26. Not pictured is a spring that inserts into the gripping portion 24 that cooperates with the actuator 26 to extend the tip 22 out from or retract into the gripping portion 24. The gripping portion 24 and actuator 26 are typically fabricated from plastic, the supply tube 20 and spring are generally fabricated from metal.

The gripping portion 24 includes a cushion 28 and first spring stopper 30. The cushion is fabricated from a relatively soft rubber to provide a hand grip for a user of the device 10. The first spring stopper 30 is generally an enlarged portion of plastic integrally joined to the gripping portion, but a separate component such as a washer or spacer may be utilized between the griping portion 24 and a first end 32 of the biasing spring 14 to restrict longitudinal motion of the first end 32 upon the slide portion 16.

The biasing spring 14 is fabricated from stainless steel, cylindrically configured when taking an end view, and comprised of multiple coils 33 having inner diameters that allow the slide portion 16 to be snugly inserted through the spring 14. The biasing spring 14, when compressed by a user's finger, then released, expands and provides sufficient force to the breaking member 18 to break a preselected window to allow a fireman or other emergency personnel to enter a premises and assist a person therein. The force required from the biasing spring 14 is dependent upon the size and type of window to be broken. The user of the device 10 must determine the "strongest" window that he or she might encounter, then utilize a spring capable of suppling sufficient force to break the window. Empirical testing will determine the correct spring 14 to use. To be certain that the spring 14 will supply the required force to break the preselected window, a breaking test of the device 10 upon the window would be performed before the device 10 is used in emergency situations. One of the more common types of glass encountered is tempered glass windows common for cars and department stores. A device 10 used to break tempered glass windows would require a biasing spring 14 similar to a spring having part number SP-9709, manufactured by Prime-Line Products Company, located in San Bernardino, Calif.

The slide member 16 may be fabricated from plastic or metal. The slide member 16 is cylindrically configured and includes an inner or first end portion 34 with a reduced circumference to promote insertion into the gripping portion 24 a predetermined distance that results with a ridge 36 engaging the first spring stopper 30 thereby maintaining the first end 32 of the biasing spring 14 upon a cylindrical wall 38 of the slide member 16. The slide member 16 further includes a second spring stopper 40 which is an enlarged section of an outer or second end portion 42 of the slide member 16. The second spring stopper 40 restricts longitudinal motion of the breaking member 18 which is forcibly biased by a second end 44 of the biasing spring 14 disposed upon the cylindrical wall 38 of the slide member 16.

Figure 5:
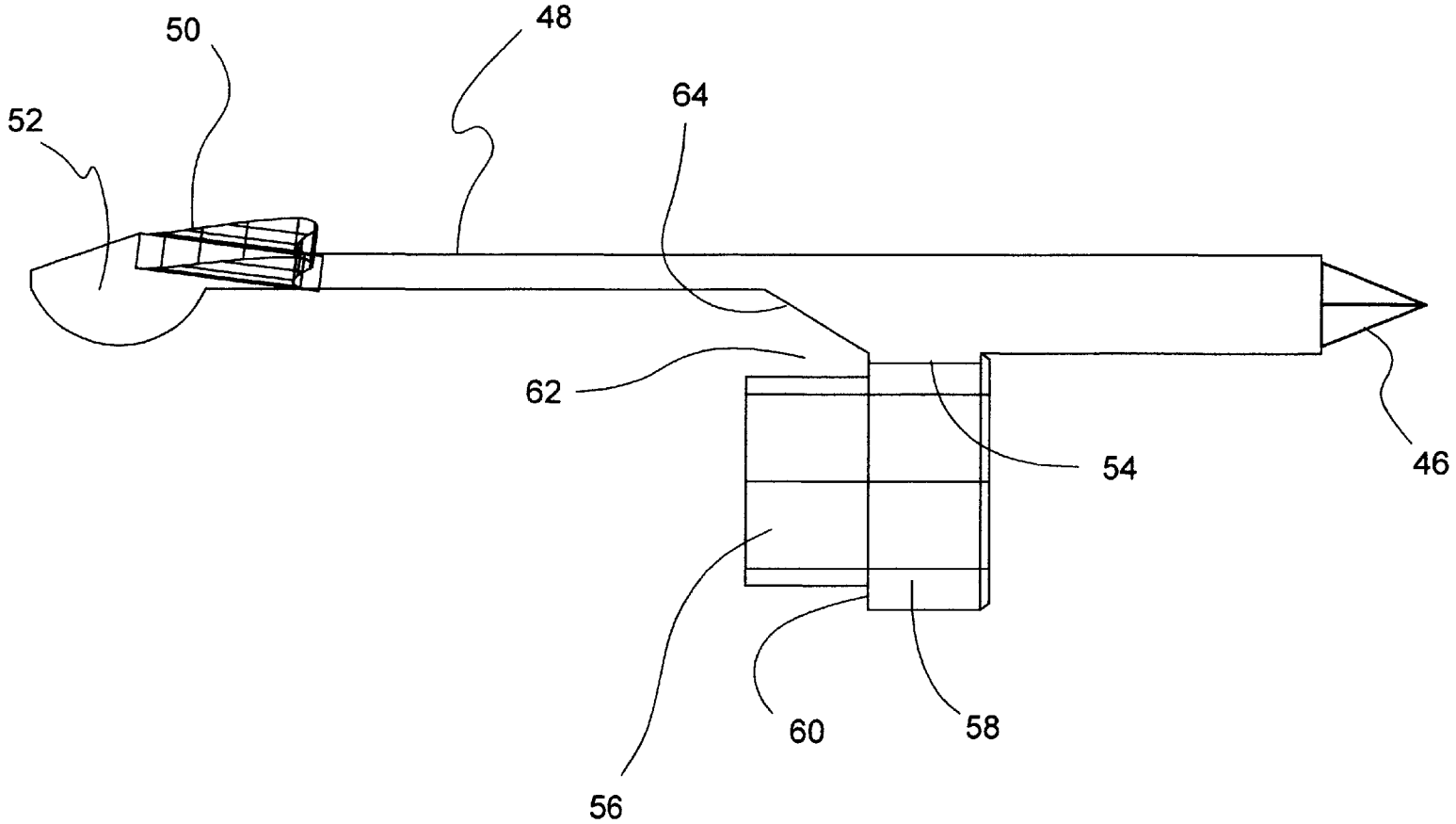
FIG. 5 is a side elevation view of a breaking member of the device of FIG. 4.
Figure 6:
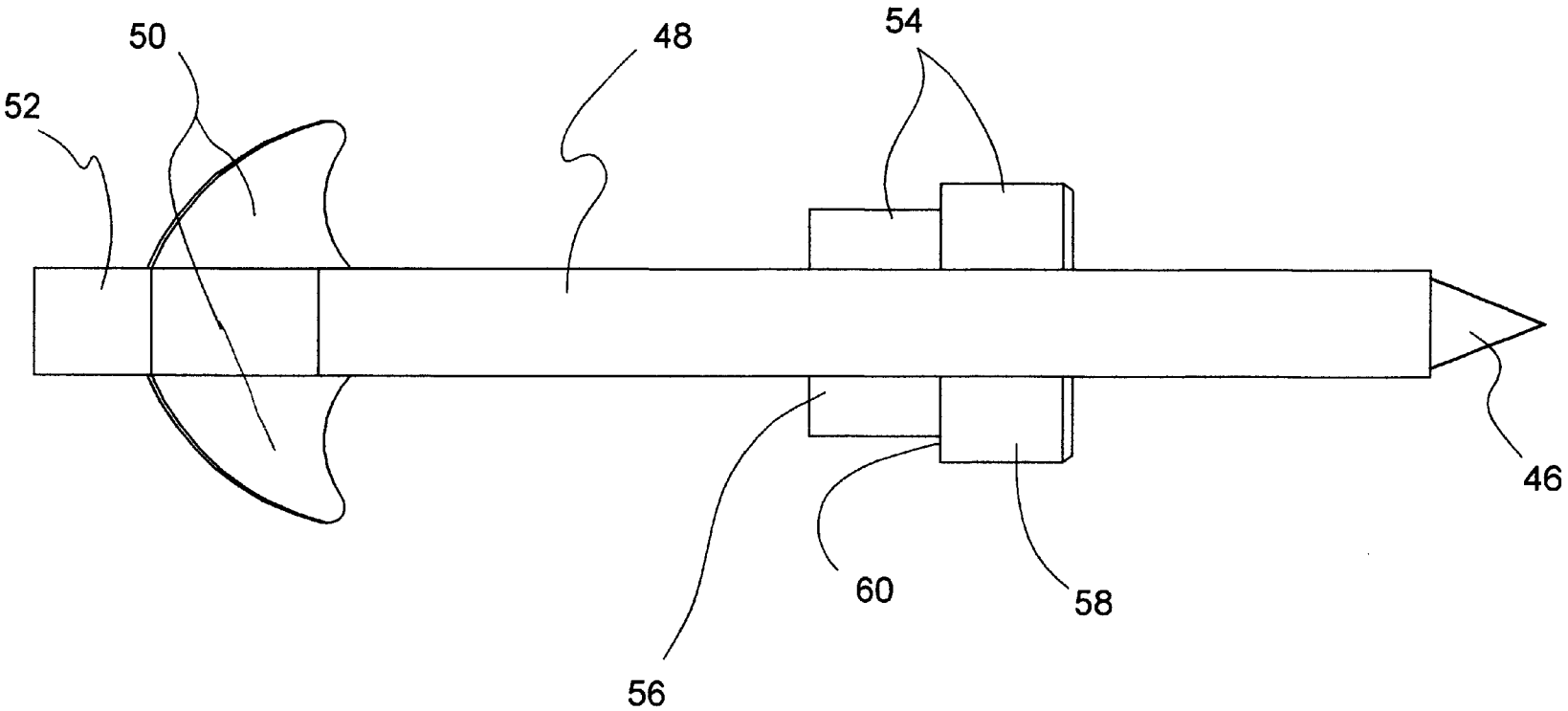
FIG. 6 is a top elevation view of the breaking member of FIG. 5.

Referring now to FIGS. 1–6, the breaking member 18 is fabricated from steel and includes a striking tip 46 comprised of a high carbon steel or similar material capable of breaking glass windows and similar objects, a clip portion 48, a protuberance or finger grip 50 integrally joined to an end portion 52 opposite the striking tip 46 of the breaking member 18, and a guide member 54. The striking tip 46 is a relatively "sharp" point that forcibly strikes and breaks a glass window when the breaking member 18 is disposed at a second or biased position by a user's finger, the breaking member 18 then being quickly released by the user to ultimately be driven into engagement with the window. The clip portion 48 allows the device 10 to be secured to an edge portion of a user's pocket for quick access to the device 10. Also, the user of the device 10 can select a clip portion 48 having a longitudinal dimension that disposes the finger grip 50 at a position that facilitates operation of the device 10 for the respective hand size of the user.

The finger grip 50 is substantially a pair of arcuate or "trigger" shaped extensions of the clip portion 48 that promote engagement between the breaking member 18 and the user's fingers. Although, the finger grip 50 is designed for two of the user's fingers to draw back the clip portion 48 thereby applying symmetrical force to opposing sides of the clip portion 48, the user could use a thumb to draw back the clip portion or just one finger if the user is sufficiently strong. The extension distance of the trigger shaped extensions of the finger grip 50 from the clip portion 48, is dependent upon the quantity of force required to compress the biasing spring 14 to generate the movement force of the striking tip 46 into a window. The larger the biasing spring 14, the greater force required to move the breaking member 18 by the user's fingers, and the greater the arcuate extension of the finger grip 50 from the clip portion 48 to facilitate movement of the breaking member 18 by the fingers of the user.

The guide member 54 is integrally joined to the breaking member 18. The guide member 54 includes an aperture 55 configured to cooperatively receive the slide member 16 therethrough, a cylindrical insertion portion 56 disposed between the biasing spring 14 and the slide member 16, and a cylindrical rim portion 58 integrally joined to and axially aligned with the insertion portion 56 and disposed between the outer or second end 44 of the biasing spring 14 and the second spring stopper 40 which is joined to the second end portion 42 of the slide member 16. The diameter of the outer wall of the cylindrical rim portion 58 is substantially equal to the outer diameter of the second spring stopper 40. The insertion portion 56 snugly inserts into the second end 44 of the biasing spring 14 until the spring 14 engages an annular stopping wall 60 formed by the circumferentially larger rim portion 58. The biasing spring 14 avoids engagement with the clip portion 48 due to the outer diameters of the spring 14 and the rim portion 58 being substantially equal, and due to a "wedge" configured gap 62 (see FIG. 5) formed by an inclined planar wall 64 near a mid-portion of the clip 48. Further, the gap 62 cooperates with an arcuate bottom wall 66 of the clip 48 to allow only minimal contact and friction between the coils 33 of the spring 14 and the end 52 of the clip portion 48 thereby minimizing the force required of a user to compress the biasing spring 14 and maximizing the force transferred from an expanding biasing spring 14 to the breaking member 18.

The longitudinal dimension of the breaking member 18 is predetermined to extend the striking tip 46 past the actuator 26 of the pen portion 12 when the biasing spring 14 and therefore the device 10 is in a non-biased or position. The greater the distance that the striking tip 46 extends beyond the actuator end of the pen portion 12, the greater the allowable separation between the pen portion 12 and a window when the spring 14 is biased thereby diminishing the chance of the striking tip not breaking the window when the finger grip 50 is released. The axial dimension of the insertion portion 56 corresponds to an insertion "depth" into the biasing spring 14 that provides stability to the breaking member 18 when released from a biased position and when engaging a window thereby promoting the breakage of the window by the striking tip 46. However, should the insertion portion 56 extend to deep into the biasing spring 14, the insertion portion 56 would restrict expansion of the spring 14 when released by the user resulting in attenuated force transfer to the striking tip 46.

In operation, a user removes the combined writing and window breaking device 10 from his or her pocket and positions the device 10 adjacent to a window to be broken to gain access to a premises because of an emergency situation that requires the user to render services therein. The user then places two fingers of one hand upon a finger grip 50 while holding the device 10 by the gripping 24 with the other hand. The user then pulls the clip portion 48 toward the gripping portion 24 thereby compressing a biasing spring 14, whereupon, the user releases the finger grip 50 to allow the spring 14 to drive a breaking member 18 with a striking tip 46 against the window to ultimately break the window thus keeping the user's hands out of "harms way" by removing any hand thrust motion toward or through the window. The user is then able to reach through the broken window to unlock any securing devices that prevented the user from gaining access to the premises.

Although, the device 10 serves the dual function of a writing instrument and a breaking device, selecting the size and force generating capability of the breaking function is critical. Upon specifying the force breaking capability, the user generally utilizes a standard pen portion 12 that includes a modified section that functions as a slide portion 16. The slide portion 16 inserts through an aperture 55 in a spring receiving portion 54 of a breaking member 18, then through a biasing spring 14 until engaging and being secured to a gripping portion 24 of the pen portion 12 thereby assembling the device 10 such that a striking tip 46 of the breaking member 18 is disposed beyond the end of the device 10 that includes the actuator 26.

The user ultimately breaks the window by first holding the device 10 via the gripping portion 24 in the palm of his or her hand. Next, the user moves the finger grip 50 with their thumb or finger to compress the biasing spring 14 upon the slide portion 16 between a first spring stopper 30 and a stopping wall 60 of rim portion 58 of the breaking member 18. The user positions the actuator 26 of the pen portion 12 adjacent to the window, then releases the finger grip 50 thereby allowing the spring 14 to expand and force the breaking member 18 against the window to break same. The movement of the breaking member 18 is ultimately stopped by the rim portion 58 of the spring receiving portion 54 engaging a second spring stopper 40 joined to a second end of the slide portion 16. When in an expanded position, the spring 14 maintains a slight bias upon the spring receiving portion 54 to prevent the breaking member 18 from moving upon the slide portion 16 when the device 10 is used a writing instrument or stored in the user's pocket.

The foregoing description is for purposes of illustrating only and is not intended to limit the scope of protection accorded this invention. The scope of protection is to be measured by the following claims, which should be interpreted as broadly as the inventive contribution permits.

What is claimed and desired to be secured by Letters Patent of the United States is:

1. A combined writing and window breaking device comprising:

a pen portion;

a breaking member cooperatively coupled to said pen portion;

means for moving said breaking member from a first position to a second position relative to said pen portion; and means for biasing said breaking member at said second position to forcibly displace said breaking member from said second position to said first position whereby said breaking member is capable of breaking a window when a predetermined portion of said pen portion is disposed proximate to the window.

2. The device of claim 1 wherein said breaking member includes a striking tip.

3. The device of claim 2 wherein said striking tip is comprised of high carbon steel.

4. The device of claim 2 wherein said striking tip is configured to extend past an actuating end of said pen portion when said device is in a non-biased position.

5. The device of claim 1 wherein said breaking member includes a clip portion.

6. The device of claim 1 wherein said moving means includes a protuberance integrally joined to said breaking member.

7. The device of claim 6 wherein said protuberance is configured to cooperatively receive at least one of the fingers of a user.

8. The device of claim 1 wherein said moving means includes a slide member secured to said pen portion.

9. The device of claim 8 wherein said moving means includes a guide member integrally joined to said breaking member, said guide member having an aperture configured to cooperatively receive said slide member.

10. The device of claim 1 wherein said biasing means includes a hand grip portion secured to said pen portion.

11. The device of claim 1 wherein said biasing means includes a spring.

12. The device of claim 11 wherein said biasing means includes first and second spring stoppers integrally joined to said pen portion.

13. The device of claim 12 wherein said biasing means includes a spring receiving portion integrally joined to said breaking member.

14. The device of claim 13 wherein said spring receiving portion includes an insertion portion disposed between said spring and a slide member, and a rim portion integrally joined to said insertion portion and disposed between an outer end of said spring and said second spring stopper.

15. A writing and breaking device comprising:

a breaking member;

means for writing;

means for slidably securing said breaking member to said writing means;

means for moving said breaking member from first to second positions; and means for biasing said breaking member when disposed at said second position such that said breaking member is forcibly returned to said first position whereby said breaking member breaks a preselected object when a predetermined portion of said device is disposed proximate to the preselected object.

16. The device of claim 15 wherein said breaking member includes a striking tip.

17. The device of claim 15 wherein said moving means includes a finger grip joined to said breaking member.

18. The device of claim 15 wherein said biasing means comprises a spring disposed between a ridge portion of said writing means and a rim portion of said breaking member.

19. The device of claim 18 wherein said breaking member includes an insertion portion disposed between and end portion of said spring on said writing means.

20. A method for combining a writing instrument with a window breaking tool, said method comprising the steps of:

providing a breaking member;

providing a writing instrument;

slidably securing said breaking member to said writing instrument;

providing means for moving said breaking member from a breaking position to a biased position;

biasing said breaking member such that said breaking member is forcibly returned to said breaking position whereby said breaking member breaks a window when a predetermined portion of said combined writing instrument and breaking tool is disposed proximate to the window.

* * * * *